US009035564B1

(12) United States Patent
Itoi et al.

(10) Patent No.: US 9,035,564 B1
(45) Date of Patent: May 19, 2015

(54) HIGH-FREQUENCY DISCHARGE IGNITION APPARATUS

(71) Applicant: Mitsubishi Electric Corporation, Chiyoda-ku, Toyko (JP)

(72) Inventors: Naoki Itoi, Chiyoda-ku (JP); Kimihiko Tanaya, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 14/168,298

(22) Filed: Jan. 30, 2014

(30) Foreign Application Priority Data

Oct. 24, 2013 (JP) ..... 2013-220833

(51) Int. Cl.
*H01T 15/00* (2006.01)
*H05H 1/46* (2006.01)

(52) U.S. Cl.
CPC . *H01T 15/00* (2013.01); *H05H 1/46* (2013.01)

(58) Field of Classification Search
CPC ..... H01T 15/00; H05H 1/46; F02P 3/0838
USPC ..... 315/224
See application file for complete search history.

(56) References Cited

U.S. PATENT DOCUMENTS

2003/0116148 A1* 6/2003 Sakakura ..... 123/630
2009/0188458 A1* 7/2009 Visser et al. ..... 123/169 R
2009/0309499 A1* 12/2009 Agneray et al. ..... 315/111.21

FOREIGN PATENT DOCUMENTS

JP 2012-112310 A 6/2012

* cited by examiner

*Primary Examiner* — Don Le
(74) *Attorney, Agent, or Firm* — Sughrue Mion, PLLC; Richard C. Turner

(57) ABSTRACT

A high-frequency discharge ignition apparatus includes: a spark discharge path generation apparatus 101 for generating predetermined high voltage and supplying the generated predetermined high voltage to an ignition plug, thereby forming a path for spark discharge in a gap; a resonance apparatus 105 composed of an inductor 117 and a capacitor 116; a current supply apparatus 103 for supplying AC current to the path for spark discharge formed in the gap, via the resonance apparatus; a current level detection apparatus 115 for detecting the level of the AC current supplied from the current supply apparatus or a level corresponding to the level of the AC current, and outputting a value corresponding to the detected level; and a control apparatus 104 for controlling output of the AC current supplied from the current supply apparatus, in accordance with the output of the current level detection apparatus.

10 Claims, 6 Drawing Sheets

HIGH-FREQUENCY DISCHARGE IGNITION APPARATUS

BACKGROUND OF THE INVENTION

1. Field of the Invention

The present invention relates to a high-frequency discharge ignition apparatus that flows high-frequency AC current into a spark discharge path to cause discharge plasma in a main plug gap, thereby igniting an internal combustion engine.

2. Description of the Background Art

In recent years, problems of environmental conservation and fuel depletion have been raised, and there is an urgent need to address such problems also in automobile industry.

As an example of methods for addressing such problems, there is a method of dramatically improving fuel consumption by engine downsizing and weight reduction by using a supercharger.

It is known that in a highly supercharged state, the pressure in an engine combustion chamber becomes very high even without combustion, so that it becomes difficult to cause spark discharge for starting combustion in the chamber in this state.

One of the reasons is that required voltage for causing insulation breakdown (in gap) between a high voltage electrode and a GND (ground) electrode of an ignition plug increases so much that the required voltage exceeds the withstand voltage value of an insulator portion of the ignition plug.

In order to solve this problem, studies for increasing the withstand voltage of the insulator portion are conducted, but actually, it is difficult to ensure a sufficient withstand voltage for the requirement, and therefore there is no choice but to employ means of narrowing the gap interval of the ignition plug.

However, if the gap of the ignition plug is narrowed, an effect of quenching action by an electrode portion increases, and this causes a problem of reducing startability and reducing combustibility.

In order to solve this problem, it is conceivable as avoidance means to provide spark discharge with energy exceeding heat to be taken by the electrode portion by quenching action or to cause combustion at a position as far from the electrode as possible. For example, an ignition coil apparatus as shown in Japanese Laid-Open Patent Publication No. 2012-112310 (hereinafter, referred to as Patent Document 1) is proposed.

The ignition coil apparatus disclosed in Patent Document 1 causes spark discharge in a gap of an ignition plug by a conventional ignition coil and flows high-frequency current into a path for spark discharge via a mixer using a capacitor, thereby making it possible to cause spark discharge with high energy and discharge plasma spreading more widely than in normal spark discharge.

The conventional ignition coil apparatus shown in Patent Document 1 separates or couples a high voltage system and a large current system by using a high withstand voltage capacitor.

Generally, a capacitor has a temperature characteristic, and its permissible value varies in accordance with variation in the environmental temperature.

Since the conventional ignition coil apparatus shown in Patent Document 1 applies AC current according to the pass frequency band of the capacitor to the path for spark discharge, the level of current to be applied to the path for spark discharge greatly varies by variation in the characteristic of the capacitor due to the temperature.

Therefore, it is conceivable to detect the current level and thereby control the frequency of the AC current according to the pass frequency band of the capacitor.

However, if the combustion state of the internal combustion engine varies so that the combustion state becomes unstable, the impedance of the spark discharge path increases, and therefore the level of current to be applied to the path for spark discharge also varies greatly, thus causing a problem that the current cannot be applied stably.

SUMMARY OF THE INVENTION

The present invention has been made to solve the above-described problem in the conventional apparatus, and an object of the present invention is to provide a high-frequency discharge ignition apparatus capable of stably applying desired AC current to a path for spark discharge even if the capacitance of a capacitor varies by variation in the environmental temperature, stably applying desired AC current to a path for spark discharge even if the combustion state of an internal combustion engine varies, and causing large discharge plasma with high efficiency.

A high-frequency discharge ignition apparatus of the present invention includes: an ignition plug for causing spark discharge between electrodes opposing each other via a gap to ignite combustible air-fuel mixture in a combustion chamber of an internal combustion engine; a spark discharge path generation apparatus for generating predetermined high voltage and supplying the generated predetermined high voltage to the ignition plug, thereby forming a path for the spark discharge in the gap; a resonance apparatus composed of an inductor and a capacitor; a current supply apparatus for supplying AC current to the path for spark discharge formed in the gap, via the resonance apparatus; a current level detection apparatus for detecting the level of the AC current supplied from the current supply apparatus or a level corresponding to the level of the AC current, and outputting a value corresponding to the detected level; and a control apparatus for controlling output of the AC current supplied from the current supply apparatus, in accordance with the output of the current level detection apparatus.

The high-frequency discharge ignition apparatus of the present invention enables control for achieving a desired current level even if the environmental temperature varies, there is variation in the constants of apparatuses, or the combustion state of an internal combustion engine varies, thus realizing high-energy discharge with high efficiency.

In addition, in the high-frequency discharge ignition apparatus of the present invention, since large AC discharge current can be supplied between electrodes of an ignition plug in an early cycle, high-energy discharge is realized with a simple configuration and with high efficiency, large discharge plasma is caused, and startability and combustibility are not impaired even if an ignition plug with a narrow gap is used. Therefore, improvement in the thermal efficiency by weight reduction and compression ratio increase by downsizing using high supercharging, and the like can be realized. Therefore, it becomes possible to dramatically reduce fuel used for driving an engine, whereby the discharge amount of $CO_2$ can be greatly reduced, thus making contribution to environmental conservation.

The foregoing and other objects, features, aspects and advantages of the present invention will become more apparent from the following detailed description when read in conjunction with the accompanying drawings.

DETAILED DESCRIPTION OF THE PREFERRED EMBODIMENTS OF THE INVENTION

First Embodiment

A high-frequency discharge ignition apparatus according to the first embodiment of the present invention is an apparatus that causes spark discharge in a main plug gap of an ignition plug by high voltage caused by an ignition coil apparatus, and flows high-frequency AC current to a spark discharge path, thereby causing large discharge plasma in the main plug gap.

Figure 1:
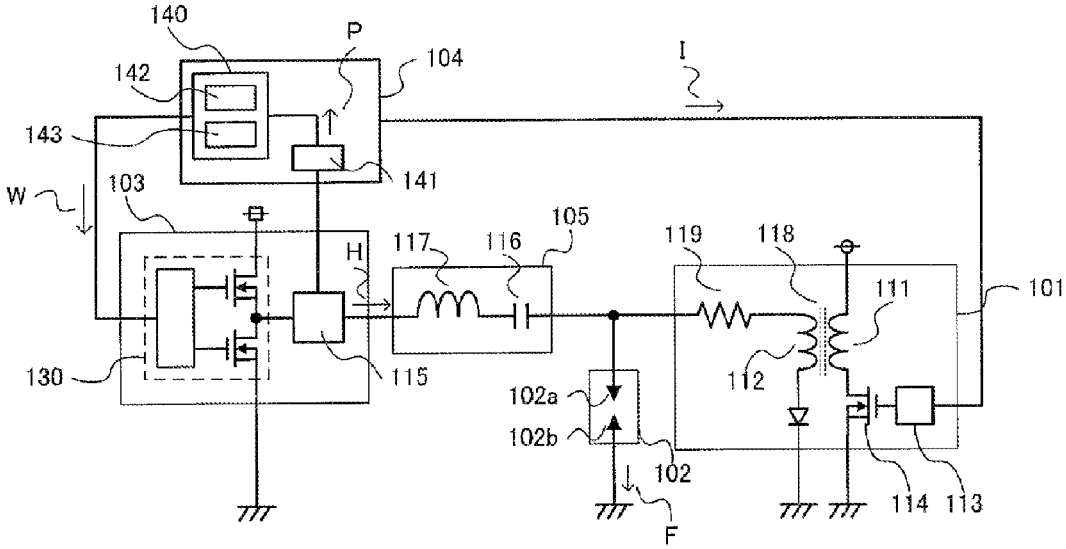
FIG. 1 is a circuit configuration diagram of a high-frequency discharge ignition apparatus according to the first embodiment of the present invention.

The configuration of the high-frequency discharge ignition apparatus according to the first embodiment will be described with reference to FIG. 1. In FIG. 1, the high-frequency discharge ignition apparatus includes: an ignition plug 102 for causing spark discharge between electrodes opposing each other via the main plug gap to ignite combustible air-fuel mixture in a combustion chamber of an internal combustion engine; an ignition coil apparatus 101 which is a spark discharge path generation apparatus for applying predetermined high voltage to the ignition plug 102; a resonance apparatus 105 composed of an inductor 117 and a capacitor 116; a current supply apparatus 103 for supplying AC current to a path for spark discharge formed in the main plug gap, via the resonance apparatus 105; a current level detection apparatus 115 for detecting the level of the AC current supplied to the path for spark discharge formed in the main plug gap or a level corresponding to the level of the AC current, and outputting a value corresponding to the detected level; and a control apparatus 104 for controlling operation of the current supply apparatus 103 in accordance with the output of the current level detection apparatus 115.

The ignition plug 102 includes a high-voltage electrode 102*a* as a first electrode, and an outside electrode 102*b* as a second electrode which faces to the high-voltage electrode 102*a* via the main plug gap which is a predetermined gap.

The ignition coil apparatus 101 includes: a primary coil 111 and a secondary coil 112 magnetically coupled with each other via a core 118; a switching device 114 for controlling current application to the primary coil 111; a driver device 113 for driving the switching device 114; and a resistor 119 for suppressing noise in a capacitance current system caused when insulation breakdown is caused in the gap (main plug gap) between the high-voltage electrode 102*a* and the outside electrode 102*b* of the ignition plug 102.

The current supply apparatus 103 includes, in the same package, a switching circuit 130 for generating AC current, and the current level detection apparatus 115 for detecting the AC current generated by the switching circuit 130.

In the case where the current level detection apparatus 115 is thus included in the package of the current supply apparatus 103, since the current level detection apparatus 115 can share some circuits (such as power supply circuit) with the switching circuit 130 and the like, the size of circuitry can be reduced, and in addition, since it is easy to provide the current level detection apparatus 115 at the same GND level as the switching circuit 130, the detection can be performed with high accuracy.

The resonance apparatus 105 includes the capacitor 116 and the inductor 117 for supplying AC current generated by the switching circuit 130 in the current supply apparatus 103, to the spark discharge path generated in the main plug gap, and the capacitor 116 and the inductor 117 form a band pass filter for blocking high voltage generated at the secondary coil 112 of the ignition coil apparatus 101 from being applied to the switching circuit 130.

The control apparatus 104 includes a microprocessor 140 for determining and controlling the operation manners of the ignition coil apparatus 101 and the current supply apparatus 103 in accordance with the current level detected by the current level detection apparatus 115, and an interface 141 for receiving a detection signal from the current level detection apparatus 115 and passing the received signal to the microprocessor 140.

The microprocessor 140 in the control apparatus 104 includes a target setting apparatus 142 for setting a target value for an output value of the current level detection apparatus 115, and a threshold value setting apparatus 143 for setting a first threshold value and a second threshold value.

The operation of the high-frequency discharge ignition apparatus according to the first embodiment will be described with reference to a timing chart in FIG. 2.

Figure 2:
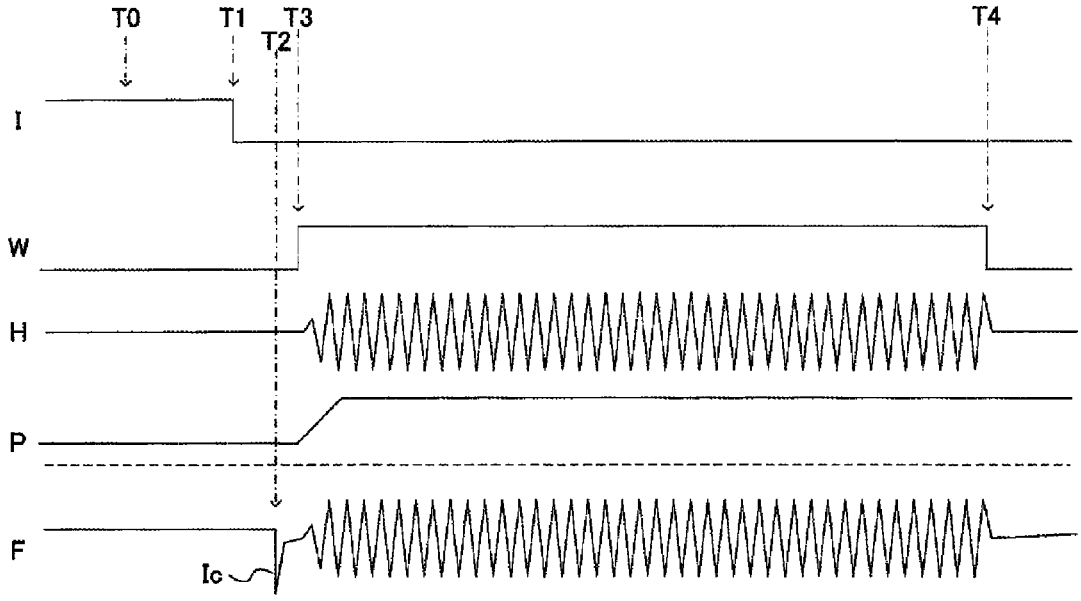
FIG. 2 is a timing chart showing the operation of the high-frequency discharge ignition apparatus according to the first embodiment of the present invention.

FIG. 2 is a timing chart showing, in time series, a signal at each section in FIG. 1.

A signal I in FIG. 2 is a signal whose positive direction is the arrow direction on a path I in FIG. 1. The signal I is a voltage signal outputted from the control apparatus 104, for driving the ignition coil apparatus 101.

A signal W in FIG. 2 is a signal whose positive direction is the arrow direction on a path W in FIG. 1. The signal W is a voltage signal outputted from the control apparatus 104 and then supplied to the switching circuit 130 in the current supply apparatus 103, and indicates a period during which the switching circuit 130 is operated.

A signal H in FIG. 2 is a signal whose positive direction is the arrow direction on a path H in FIG. 1. The signal H is a current signal indicating AC current generated by the switching circuit 130.

A signal P in FIG. 2 is a signal on a path P in FIG. 1, which is a signal peak-held by the interface 141.

A signal F in FIG. 2 is a signal whose positive direction is the arrow direction on a path F in FIG. 1. The signal F is a current signal indicating discharge current flowing on a spark discharge path formed in the main plug gap of the ignition plug 102.

At a timing T0 in FIG. 2, since the signal I has already become HIGH, the switching device 114 in the ignition coil apparatus 101 is in ON state, and the primary coil 111 is in current-applied state. Therefore, magnetic flux energy is being accumulated in the core 118.

At a timing T1, when the signal I is switched to LOW, current application to the primary coil 111 is interrupted by the switching device 114 in the ignition coil apparatus 101, and the magnetic flux energy accumulated in the core 118 is released. Then, induced voltage occurs on the secondary coil 112, so that induced current starts to flow, and meanwhile, charging of the ground capacitance that the ignition plug 102 potentially has and charging of the capacitor 116 are started.

At a timing T2, when charged voltage of the ground capacitance of the ignition plug 102 and charged voltage of the capacitor 116 have reached the insulation breakdown voltage of the main plug gap of the ignition plug 102, insulation breakdown occurs in the main plug gap, so that a spark discharge path is formed. Then, current due to discharge of the electric charge accumulated in the capacitance, i.e., so-called capacitance current Ic flows into the spark discharge path.

In order that AC current is applied from about the time when the capacitance current Ic has stopped, the control apparatus 104 switches the signal W to HIGH at a timing T3, to permit the operation of the switching circuit 130.

When the operation of the switching circuit 130 is permitted by the signal W, the switching circuit 130 starts switching operation so as to send AC current into the spark discharge path formed in the main plug gap.

In the first embodiment, since the switching circuit 130 has a half-bridge configuration and the band pass filter formed by the inductor 117 and the capacitor 116 is provided at the stage subsequent to the switching circuit 130, the switching circuit 130 is operated so that the HIGH-side switch and the LOW-side switch of the half bridge are alternately turned ON or OFF along with the resonance frequency of the band pass filter.

By switching the half-bridge circuit along with the resonance frequency of the band pass filter, the impedance of the band pass filter section is minimized, so that output current of the current supply apparatus 103 flowing on the path H is maximized. Therefore, the maximum AC current can be sent into the spark discharge path in the main plug gap.

At a timing T4, the control apparatus 104 switches the signal W to LOW to stop the operation of the switching circuit 130.

When the operation of the switching circuit 130 has stopped, supply of large AC current to the spark discharge path in the main plug gap is also stopped.

In order to determine the signal level peak-held by the interface 141, the microprocessor 140 in the control apparatus 104 takes in this signal by using an A/D converter.

In order to take in a high-frequency AC signal in a megahertz band by using an A/D converter and perform data processing, an expensive A/D converter or an expensive microcomputer with high performance is needed. Therefore, in the first embodiment, the interface 141 formed by a peak-holding circuit is prepared so that a signal level can be read by using an inexpensive microprocessor and an inexpensive A/D converter for general purpose.

The microprocessor 140 takes in the signal P by using the A/D converter at a timing after the timing T4, and then, after the taking operation is finished, the microprocessor 140 resets the peak holding.

A control procedure of the high-frequency discharge ignition apparatus of the first embodiment will be described with reference to a flowchart in FIG. 3.

Figure 3:
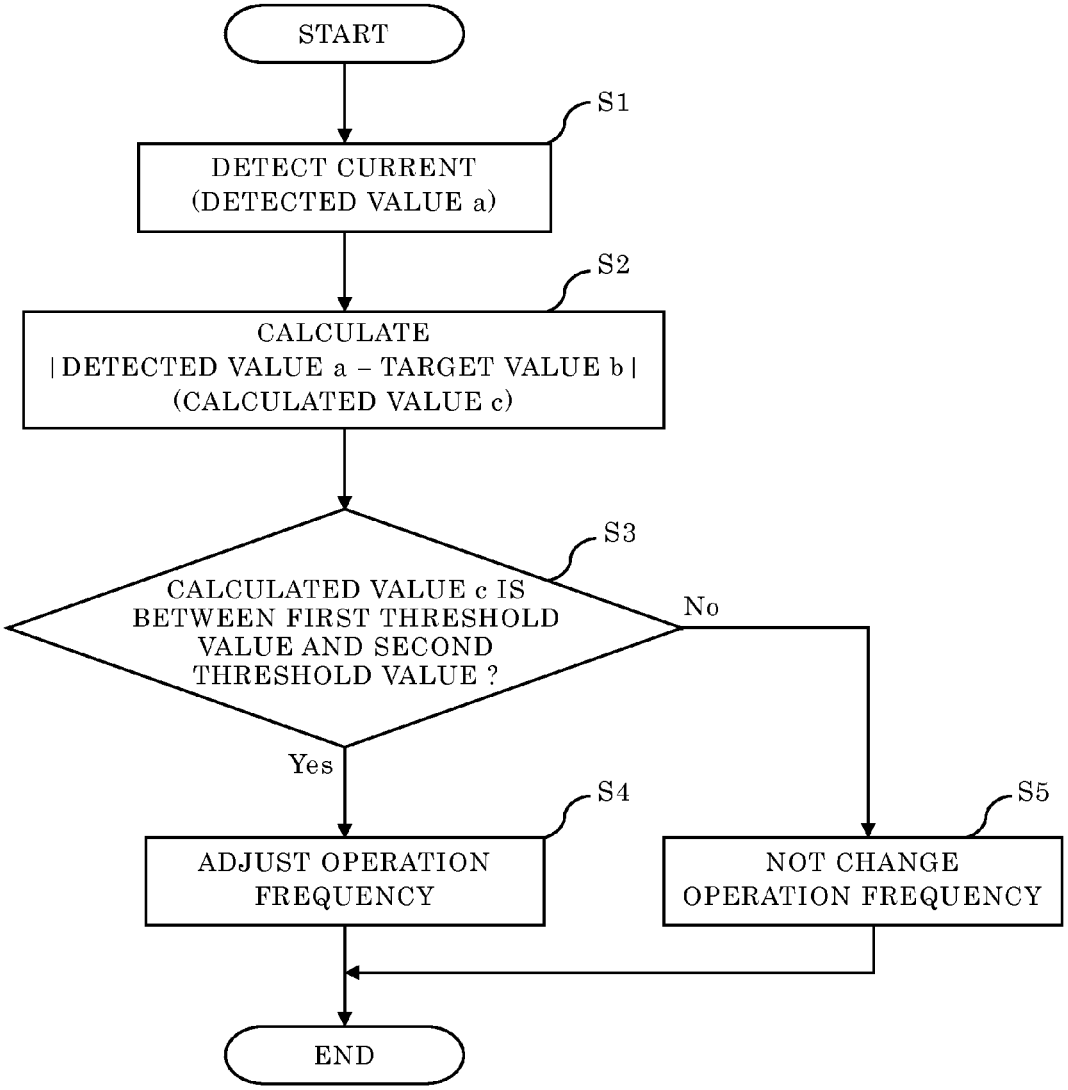
FIG. 3 is a flowchart showing a control procedure of the high-frequency discharge ignition apparatus according to the first embodiment of the present invention.

In FIG. 3, in step S1, after the period during which the current supply apparatus 103 supplies AC current to the path for spark discharge formed in the main plug gap is ended, the microprocessor 140 takes in a signal peak-held by the interface 141 by using the A/D converter. The taken signal is defined as a detected value a.

The microprocessor 140 resets the peak holding after the taking operation by the A/D converter.

In step S2, the microprocessor 140 calculates the absolute value of a difference between the detected value a detected in step S1 and a target value b set by the target setting apparatus 142 in the microprocessor 140. The absolute value is defined as a calculated value c.

For example, it will be assumed that the detected value a detected in step S1 is 4 amperes and the target value b set by the target setting apparatus 142 is 3 amperes.

The microprocessor 140 calculates the absolute value of a difference between 4 amperes of the detected value a and 3 amperes of the target value b, so that the calculated value c is 1 ampere.

Here, since the calculated value c is an absolute value, subsequent calculation can be performed without considering the magnitude relationship between the detected value a and the target value b.

The target value b may be a map value or a calculated value set depending on the operation condition, the discharge state, and the like.

For example, when the temperature of engine cooling water is smaller than 80° C. and the engine rotation rate is equal to or smaller than 1000 rotations/minute, the target value b is set at 5 amperes. When the engine rotation rate exceeds 3000 rotations/minute, the target value b is set at 4 amperes. When the engine rotation rate exceeds 4000 rotations/minute, the target value b is set at 3 amperes.

When the temperature of engine cooling water exceeds 80° C., 1 ampere is subtracted from each target value b.

In step S3, the microprocessor 140 determines whether the calculated value c calculated in step S2 is between the first threshold value and the second threshold value set by the threshold value setting apparatus 143 in the microprocessor 140.

For example, it will be assumed that the first threshold value set by the threshold value setting apparatus 143 is 0.5 amperes and the second threshold value is 2 amperes.

If the calculated value c calculated in step S2 is 1 ampere, the calculated value c is between 0.5 amperes of the first threshold value and 2 amperes of the second threshold value, and therefore the determination result is positive.

If the calculated value c is 0.3 amperes, the calculated value c is not between 0.5 amperes of the first threshold value and 2 amperes of the second threshold value, and therefore the determination result is negative.

In this case, since the calculated value c is smaller than 0.5 amperes of the first threshold value, it is determined that the detected value a is sufficiently close to the target value b.

If the calculated value c is 3 amperes, the calculated value c is not between 0.5 amperes of the first threshold value and 2 amperes of the second threshold value, and therefore the determination result is negative.

In this case, since the calculated value c is greater than 2 amperes of the second threshold value, it is determined that the detected value a includes detection of abnormal state such as noise.

The first threshold value and the second threshold value may each be a map value set depending on the operation condition, the discharge state, and the like.

The reason is as follows. When the engine rotation rate or a state of load, temperature, or the like varies, the insulation breakdown voltage in the main plug gap also varies, and therefore noise is superimposed onto the detected value a detected in step S1, so that the detected value a becomes greater than its real value. In addition, when the combustion state in the internal combustion engine varies and thus the combustion state becomes unstable, the impedance of the spark discharge path in the main plug gap increases, and therefore current that can be flown to the ignition plug 102 decreases, so that the detected value a becomes a small value.

In step S4, if the determination result in step S3 is positive, the microprocessor 140 determines an adjustment amount for the operation frequency of the switching circuit 130 in accordance with the calculated value c, and then instructs the switching circuit 130 accordingly.

The adjustment amount for the operation frequency in the instruction may be a map value or a calculated value.

The reason is as follows. When the calculated value c is great, if the microprocessor 140 increases the adjustment amount for the operation frequency in the instruction to the switching circuit 130, a time taken until the calculated value c is controlled to be the target value b can be reduced. In addition, when the calculated value c is small, if the microprocessor 140 decreases the adjustment amount for the operation frequency, the calculated value c can be stably controlled to be the target value b without overshoot.

In addition, the adjustment in step S4 may be such that the adjusted operation frequency is always higher than a resonance frequency of the band pass filter of the resonance apparatus 105.

Thus, the operation frequency can be uniquely determined such that if the calculated value c is lower than the target value b, the operation frequency of the switching circuit 130 is decreased, and if the calculated value c is higher than the target value b, the operation frequency of the switching circuit 130 is increased.

As a matter of course, the switching circuit 130 may be always controlled in a region lower than the resonance frequency of the band pass filter of the resonance apparatus 105.

In this case, the above theory just inverts.

As an example for reference, the operation frequency of the switching circuit 130 is 1 to 4 MHz, and the adjustment amount is about 100 Hz to 100 kHz.

In step S5, if the determination result in step S3 is negative, the microprocessor 140 instructs the switching circuit 130 to maintain the present operation frequency without changing the operation frequency.

Thus, when the detected value a is sufficiently close to the target value b, the present current level can be maintained.

In addition, since the control is prevented from being performed when the detected value a is in an abnormal state such as containing noise, the current level can be controlled with high accuracy.

Thus, the first embodiment provides the ignition coil apparatus 101, the current supply apparatus 103 for supplying high-frequency energy to the resonance apparatus 105, and the control apparatus for adjusting the operation frequency of the current supply apparatus 103 based on a signal detected by the current level detection apparatus 115 in the current supply apparatus 103, whereby even if the environmental temperature varies, there is variation in the constants of apparatuses, or the combustion state of the internal combustion engine varies, the current level can be controlled to be a desired level, large discharge plasma can be efficiently formed, and startability and combustibility are not impaired even if an ignition plug with a narrow gap is used. Therefore, improvement in the thermal efficiency by weight reduction and compression ratio increase by downsizing using high supercharging, and the like can be realized.

Therefore, it becomes possible to comparatively reduce fuel used for driving an internal combustion engine, whereby the discharge amount of $CO_2$ can be greatly reduced, thus making great contribution to environmental conservation.

Particularly, the microprocessor 140 instructs the switching circuit 130 for the operation frequency in accordance with variation in the current level due to variation in the environmental temperature or variation in the constants of apparatuses, and variation in the current level due to variation in the combustion state of the internal combustion engine, whereby the current level can be controlled with high accuracy.

Second Embodiment

The configuration of a high-frequency discharge ignition apparatus according to the second embodiment will be described with reference to FIG. 4. In the high-frequency discharge ignition apparatus of the second embodiment, as compared to the configuration of the first embodiment, the microprocessor 140 in the control apparatus 104 includes an averaging apparatus 144 for averaging output values outputted a plurality of times from the current level detection apparatus 115 and outputting the averaged value, and the averaging apparatus 144 is provided with a selecting apparatus 145 for selecting specific output values having high reliability among output values outputted a plurality of times from the current level detection apparatus 115.

During a period in which the current supply apparatus 103 supplies AC current to the path for spark discharge formed in the main plug gap, the current level detection apparatus 115 detects the level of the AC current or a level corresponding to the level of the AC current a plurality of times, at least twice, and then outputs values corresponding to the detected levels.

The operation of the high-frequency discharge ignition apparatus according to the second embodiment will be described with reference to a timing chart in FIG. 5.

Figure 4:
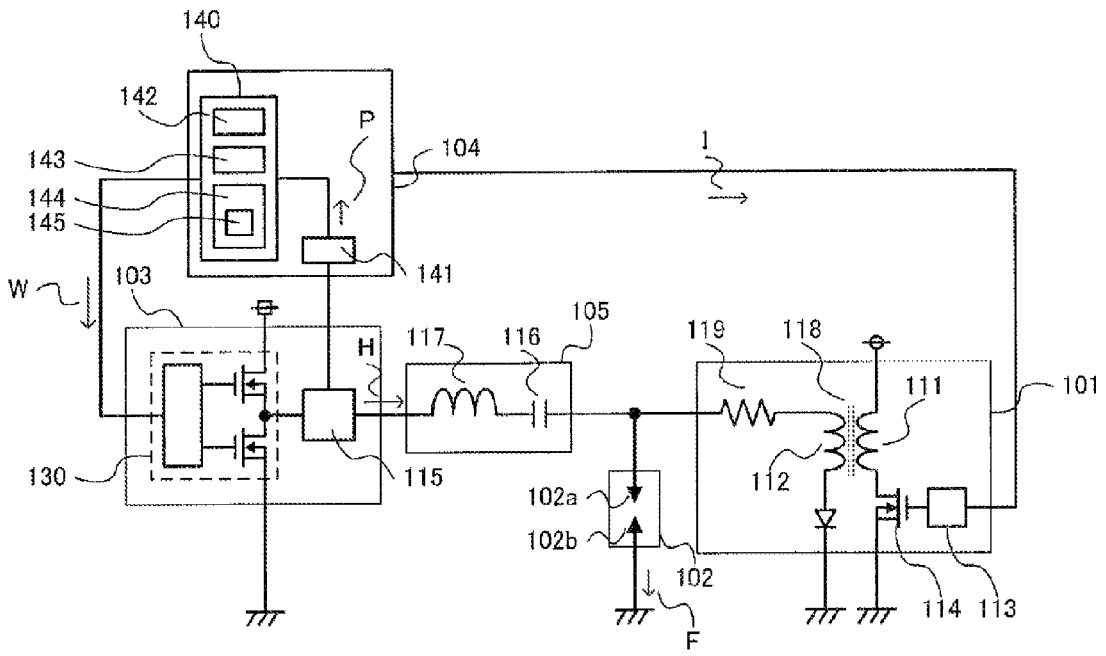
FIG. 4 is a circuit configuration diagram of a high-frequency discharge ignition apparatus according to the second embodiment of the present invention.
Figure 5:
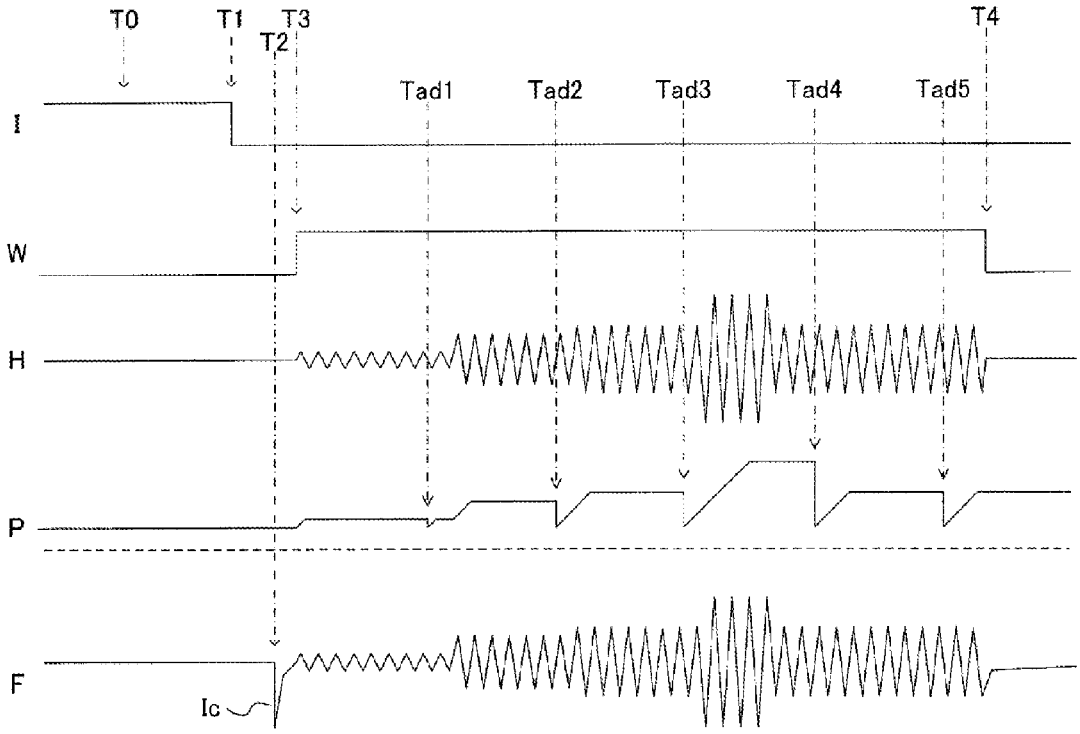
FIG. 5 is a timing chart showing the operation of the high-frequency discharge ignition apparatus according to the second embodiment of the present invention.

FIG. 5 is a timing chart showing, in time series, a signal at each section in FIG. 4.

Each signal and the timings T1 to T4 in FIG. 5 are the same as in the first embodiment.

Timings of Tad1 to Tad5 in FIG. 5 are timings at which the microprocessor 140 in the control apparatus 104 takes in a signal peak-held by the interface 141, by using the A/D converter, at regular intervals during a period in which the current supply apparatus 103 supplies AC current to the path for spark discharge formed in the main plug gap.

The microprocessor 140 resets the peak holding every time the taking operation by the A/D converter is finished.

A control procedure of the high-frequency discharge ignition apparatus according to the second embodiment will be described with reference to a flowchart in FIG. 6.

Figure 6:
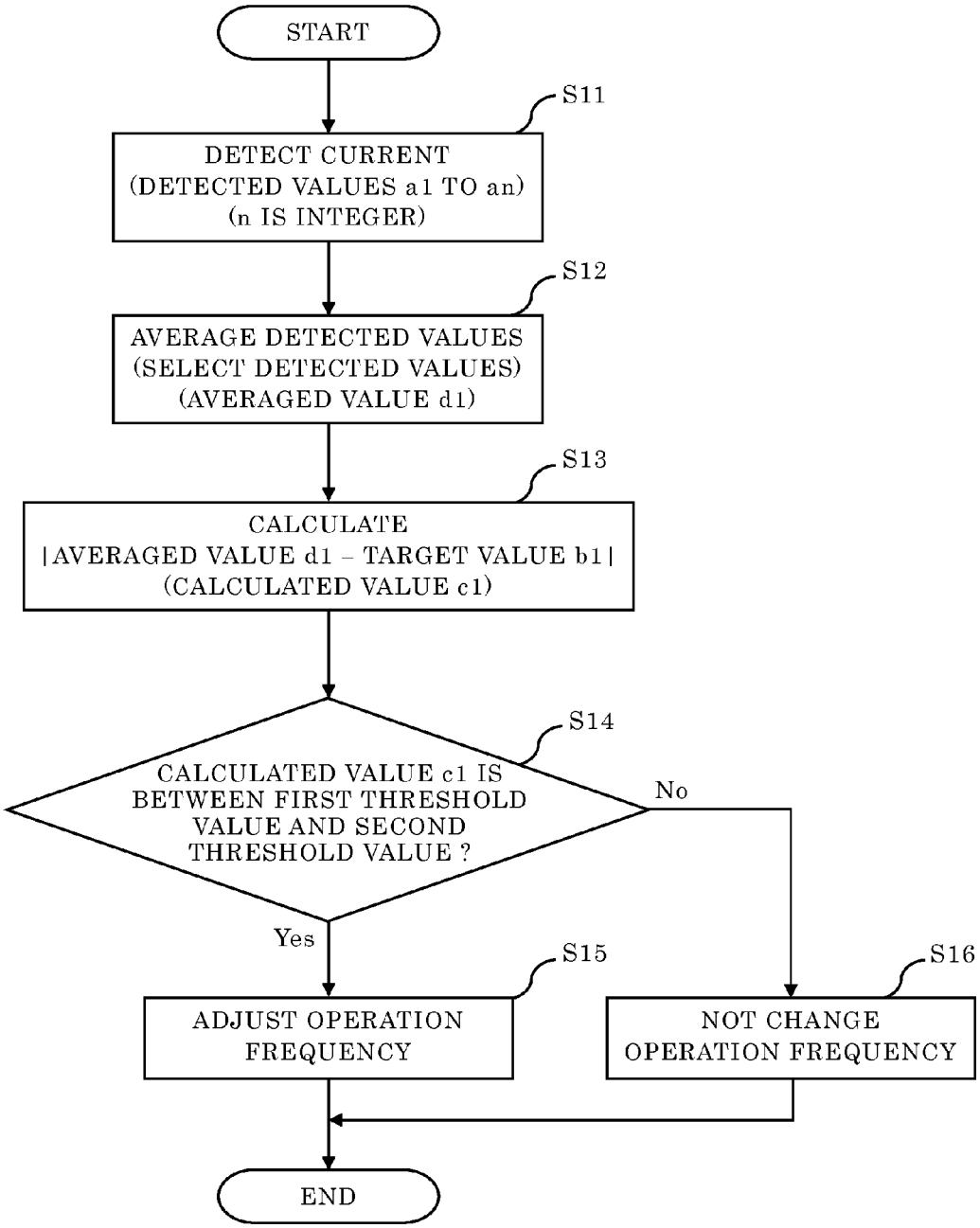
FIG. 6 is a flowchart showing a control procedure of the high-frequency discharge ignition apparatus according to the second embodiment of the present invention.

In FIG. 6, in step S11, the microprocessor 140 takes in a signal peak-held by the interface 141, by using the A/D converter, at regular intervals during a period in which the current supply apparatus 103 supplies AC current to the path for spark discharge formed in the main plug gap. The taken signals are defined as detected values a11 to a1n (n is an integer).

The microprocessor 140 resets the peak holding every time the taking operation by the A/D converter is finished.

In step S12, after the period during which the current supply apparatus 103 supplies AC current is ended, the averaging apparatus 144 in the microprocessor 140 averages only detected values selected by the selecting apparatus 145 in the averaging apparatus 144 among the detected values a11 to a1n (n is an integer) detected in step S11. The averaged value is defined as an averaged value d1.

For example, it will be assumed that a total of four detected values are detected in step S11, the detected value a11 is 3.4 amperes, the detected value a12 is 4 amperes, the detected value a13 is 4.6 amperes, and the detected value a14 is 8 amperes.

In the case where the selecting apparatus 145 in the averaging apparatus 144 sets the upper limit value for each detected value at 6 amperes, the averaging apparatus 144 averages three of the detected value a11, the detected value a12, and the detected value a13, excluding the detected value a14, so that the averaged value d1 is 4 amperes.

By excluding a singular detected value from the detected values upon averaging, high reliability of the detected values can be ensured and controllability is also improved.

In addition, the selecting apparatus 145 in the averaging apparatus 144 may set not only an upper limit value but also a lower limit value, thereby selecting detected values having further high reliability.

In step S13, the microprocessor 140 calculates the absolute value of a difference between the averaged value d1 calculated in step S12 and a target value b1 set by the target setting apparatus 142 in the microprocessor 140. The absolute value is defined as a calculated value c1.

For example, it will be assumed that the averaged value d1 calculated in step S12 is 4 amperes and the target value b1 set by the target setting apparatus 142 is 3 amperes.

The microprocessor 140 calculates the absolute value of a difference between 4 amperes of the averaged value d1 and 3 amperes of the target value b1, so that the calculated value c1 is 1 ampere.

Here, since the calculated value c1 is an absolute value, subsequent calculation can be performed without considering the magnitude relationship between the averaged value d1 and the target value b1.

In addition, the target value b1 may be a map value or a calculated value set depending on the operation condition, the discharge state, and the like.

For example, when the temperature of engine cooling water is smaller than 80° C. and the engine rotation rate is equal to or smaller than 1000 rotations/minute, the target value is set at 5 ampere peak. When the engine rotation rate exceeds 3000 rotations/minute, the target value is set at 4 ampere peak. When the engine rotation rate exceeds 4000 rotations/minute, the target value is set at 3 ampere peak.

When the temperature of engine cooling water exceeds 80° C., 1 ampere is subtracted from each target value.

In step S14, as in step S3 of the first embodiment, the microprocessor 140 determines whether the calculated value c1 calculated in step S13 is between the first threshold value and the second threshold value set by the threshold value setting apparatus 143 in the microprocessor 140.

In step S15, as in step S4 of the first embodiment, if the determination result in step S14 is positive, the microprocessor 140 determines an adjustment amount for the operation frequency of the switching circuit 130 in accordance with the calculated value c1, and then instructs the switching circuit 130 for the operation frequency.

In step S16, as in step S5 of the first embodiment, if the determination result in step S14 is negative, the microprocessor 140 instructs the switching circuit 130 to maintain the present operation frequency without changing the operation frequency.

Thus, in the second embodiment, as compared to the configuration of the first embodiment, the microprocessor 140 in the control apparatus 104 includes the averaging apparatus 144 for averaging output values outputted a plurality of times from the current level detection apparatus 115 and outputting the averaged value, and the averaging apparatus 144 is provided with the selecting apparatus 145 for selecting output values having high reliability among output values outputted a plurality of times from the current level detection apparatus 115, whereby even if the environmental temperature varies, there is variation in the constants of apparatuses, or the combustion state of the internal combustion engine varies, the current level can be controlled to be a desired level with high accuracy, large discharge plasma can be efficiently formed, and startability and combustibility are not impaired even if an ignition plug with a narrow gap is used. Therefore, improvement in the thermal efficiency by weight reduction and compression ratio increase by downsizing using high supercharging, and the like can be realized.

Therefore, it becomes possible to comparatively reduce fuel used for driving an internal combustion engine, whereby the discharge amount of CO2 can be greatly reduced, thus making great contribution to environmental conservation.

Particularly, during a period in which the current supply apparatus 103 supplies AC current to the path for spark discharge formed in the main plug gap, the current level detection apparatus 115 detects the level of the AC current or a level corresponding to the level of the AC current a plurality of times, at least twice, and the control is performed based on the output corresponding to the detected levels, whereby the microprocessor 140 can instruct the switching circuit 130 for the operation frequency in accordance with variation in the current level due to variation in the environmental temperature or variation in the constants of apparatuses, and variation in the current level due to variation in the combustion state of the internal combustion engine, caused during the period in which the current supply apparatus 103 supplies the AC current to the path for spark discharge formed in the main plug gap. Thus, the current level can be controlled with high accuracy.

The high-frequency discharge ignition apparatus according to the present invention can be applied to an automobile, a two-wheel vehicle, an outboard engine, and other special machines using an internal-combustion engine, so that ignition of fuel can be reliably performed. Therefore, the internal combustion engine can be operated with high efficiency, thus serving for solving a fuel depletion problem and the environmental conservation.

It is noted that, within the scope of the present invention, the above embodiments may be freely combined with each other, or each of the above embodiments may be modified or abbreviated as appropriate.

Various modifications and alterations of this invention will be apparent to those skilled in the art without departing from the scope and spirit of this invention, and it should be understood that this is not limited to the illustrative embodiments set forth herein.

What is claimed is:

1. A high-frequency discharge ignition apparatus comprising:

an ignition plug for causing spark discharge between electrodes opposing each other via a gap to ignite combustible air-fuel mixture in a combustion chamber of an internal combustion engine;

a spark discharge path generation apparatus for generating predetermined high voltage and supplying the generated predetermined high voltage to the ignition plug, thereby forming a path for the spark discharge in the gap;

a resonance apparatus configured to form a band pass filter;

a current supply apparatus for supplying AC current to the path for spark discharge formed in the gap, via the resonance apparatus;

a current level detection apparatus for detecting the level of the AC current supplied from the current supply apparatus or a level corresponding to the level of the AC current, and outputting a value corresponding to the detected level; and a control apparatus for controlling output of the AC current supplied from the current supply apparatus, in accordance with the output of the current level detection apparatus.

2. The high-frequency discharge ignition apparatus according to claim 1, wherein the control apparatus controls the frequency of the AC current supplied from the current supply apparatus, in accordance with the output of the current level detection apparatus.

3. The high-frequency discharge ignition apparatus according to claim 2, wherein the current supply apparatus includes a switching circuit connected to the resonance apparatus, and the control apparatus adjusts the operation frequency of the switching circuit in accordance with the output of the current level detection apparatus.

4. The high-frequency discharge ignition apparatus according to claim 1, wherein during a period in which the current supply apparatus supplies the AC current, the current level detection apparatus detects the level of the AC current or a level corresponding to the level of the AC current at least a plurality of times, and outputs values corresponding to the detected levels.

5. The high-frequency discharge ignition apparatus according to claim 4, wherein the control apparatus includes an averaging apparatus for averaging the values outputted the plurality of times from the current level detection apparatus, and outputting the averaged value, and the control apparatus controls the frequency of the AC current supplied from the current supply apparatus, in accordance with the averaged value outputted from the averaging apparatus.

6. The high-frequency discharge ignition apparatus according to claim 5, wherein the averaging apparatus includes a selecting apparatus for selecting specific output values among the values outputted the plurality of times from the current level detection apparatus, and the averaging apparatus outputs an averaged value obtained by averaging the output values selected by the selecting apparatus.

7. The high-frequency discharge ignition apparatus according to claim 1, wherein the control apparatus includes a target setting apparatus for setting a target value for the value outputted from the current level detection apparatus, and a threshold value setting apparatus for setting a first threshold value and a second threshold value, and when the absolute value of a difference between the target value and the value outputted from the current level detection apparatus is between the first threshold value and the second threshold value, the control apparatus controls the current supply apparatus so that the output value approaches the target value.

8. The high-frequency discharge ignition apparatus according to claim 7, wherein each of the target value, the first threshold value, and the second threshold value is a map value according to an operation state.

9. The high-frequency discharge ignition apparatus according to claim 7, wherein the control apparatus changes an adjustment amount for the frequency of the AC current supplied from the current supply apparatus, in accordance with the absolute value of the difference between the target value and the value outputted from the current level detection apparatus.

10. The high-frequency discharge ignition apparatus according to claim 3, wherein the current level detection apparatus is provided, together with the switching circuit, in the same package.

* * * * *